United States Patent [19]

Oglander et al.

[11] 3,991,906

[45] Nov. 16, 1976

[54] LABEL DISPENSING MACHINE

[76] Inventors: Allen H. Oglander, 9 Sackston Woods, St. Louis County, Mo. 63141; Richard E. Shannon, 355 Albert, St. Louis County, Mo. 63031

[22] Filed: Sept. 8, 1975

[21] Appl. No.: 611,343

[52] U.S. Cl. ..... 221/73

[51] Int. Cl.[2] ..... B65C 9/18

[58] Field of Search ..... 221/69–73; 83/203, 205, 261, 422

[56] References Cited

UNITED STATES PATENTS

| | | | |
|---|---|---|---|
| 2,802,598 | 8/1957 | Petterson | 221/73 X |
| 3,169,895 | 2/1965 | Sohn | 221/73 X |
| 3,537,933 | 11/1970 | Severance | 221/73 X |

*Primary Examiner*—Stanley H. Tollberg
*Attorney, Agent, or Firm*—Ralph W. Kalish

[57] ABSTRACT

A label dispensing machine which is adapted to receive a supply of independent rolls of backing material each carrying readily detachable, adhesive coated labels thereon. A parting or discharge edge is provided for movement thereover of the backing strips to cause withdrawal of the strip from the supported labels for freeing of the latter. A control shaft is presented for supporting keys corresponding to each independent roll, said keys being so engaged upon said shaft as to effect rocking of the same upon depression of any of such keys; there being a prime mover, a normally open control switch therefor, and with a drive shaft operatively engaged to said prime mover. Said control shaft mounts an arm for closing said control switch upon rocking of the shaft pursuant to key depression. Each key is so disposed with respect to the drive shaft that upon depression of each key the same cooperates with the drive shaft to pull the selected backing strip over said discharge edge.

12 Claims, 6 Drawing Figures

LABEL DISPENSING MACHINE

BACKGROUND AND SUMMARY OF THE INVENTION

This invention relates in general to label dispensing and, more particularly, to a machine for facilitating the selected removal of adhesive-coated labels from a multiple source.

It is an object of the present invention to provide a machine which efficiently and reliably operates to remove adhesive labels and the like from a backing sheet normally in roll form, and which constitutes a unit of a multiplicity of discrete rolls so that the operator may select the desired label from the potential variety provided.

It is a further object of the present invention to provide a machine of the character stated which may be operated in a rapid, reliable manner to effect the desired label removal without requiring laborious pulling action by the individual upon the label to be discharged.

It is a further object of the present invention to provide a machine of the character stated which is adapted to accommodate a substantially untold number of discrete label rolls, based, of course, upon size considerations, so that by means of a single machine a wide range of label needs may be accommodated.

It is another object of the present invention to provide a machine of the character stated which is adapted to operate with the least action on the part of the user, such as by merely depressing a key so that operation is comfortably and non-fatiguingly achieved; and wherein any predetermined number of labels may be removed from a single roll upon any specific operation; the same being at the discretion of the operator.

It is a still further object of the present invention to provide a machine for label dispensing which is most economically manufactured, having a marked simplicity of durable parts thereby rendering the machine extremely resistant to breakdown so that longevity of operation is assured.

It is a still further object of the present invention to provide a machine of the character stated which permits of replenishment of label sources with the least effort so that there is in effect no down-time for refilling purposes.

It is another object of the present invention to provide a machine for dispensing labels upon a selective basis from a multiple label source; which is highly durable; which is economical in production, as well as in operation; the use of which does not require the services of a skilled operator; and which in operation is designed to meet a multiplicity of label usages.

DESCRIPTION OF THE PREFERRED EMBODIMENT

Figure 1:
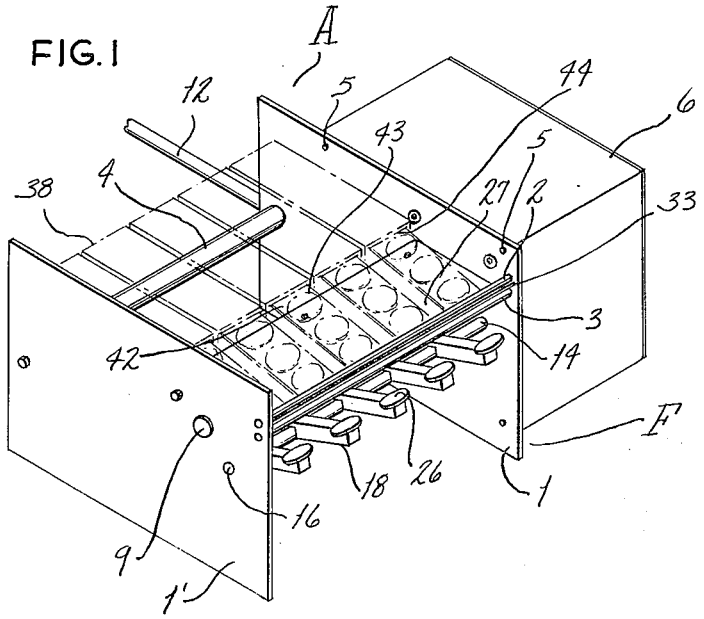
FIG. 1 is a perspective view of a label dispensing machine constructed in accordance with and embodying the present invention, illustrating a multiplicity of label supply sources in label feeding disposition.

Referring now by reference numerals to the drawings which illustrate the preferred embodiment of the present invention, A designates a label dispensing machine having a frame indicated generally F comprised of a pair of opposed rectangular slide plates 1,1′ in spaced-apart, parallel relationship and being maintained fixedly in said relationship by virtue of a plurality of transversely extending bars, as at 2, 3, and 4 which are fixed at their ends in said plates 1,1′ and to be described more fully hereinbelow. Mounted fixedly on the exterior face of plate 1, as by screws 5, is a housing 6 for a prime mover M connected by a drive shaft (not shown) to a gear reducer 7 driving a shaft 8 which projects through and is journalled within plate 1 and with its remote end similarly journalled within a bearing 9 formed in plate 1′. Disposed encirclingly about shaft 8 between plates 1,1′ is a yieldable friction sleeve 10 for purposes to be shown. Suitably connected to prime mover M is a normally open control switch *m*, as of the microswitch type, having a depending actuating arm 11, there being the customary circuitry as broadly indicated at C comprehending a multiplicity of conductors for interconnecting prime mover M and microswitch *m* to a convenient source of voltage, such as 110 volts, exterior of housing 6, as by means of a cable 12.

Provided within housing 6 is a switch control arm 13 extending at its rearward end downwardly and rearwardly beneath actuating arm 11 and in its forward portion being carried upon one end of a control shaft 14 which is journalled within a bearing, as at 15, in side plate 1 and extends transversely between the same and side plate 1′ within which latter its opposite end is journalled, as at 16.

Figure 4:
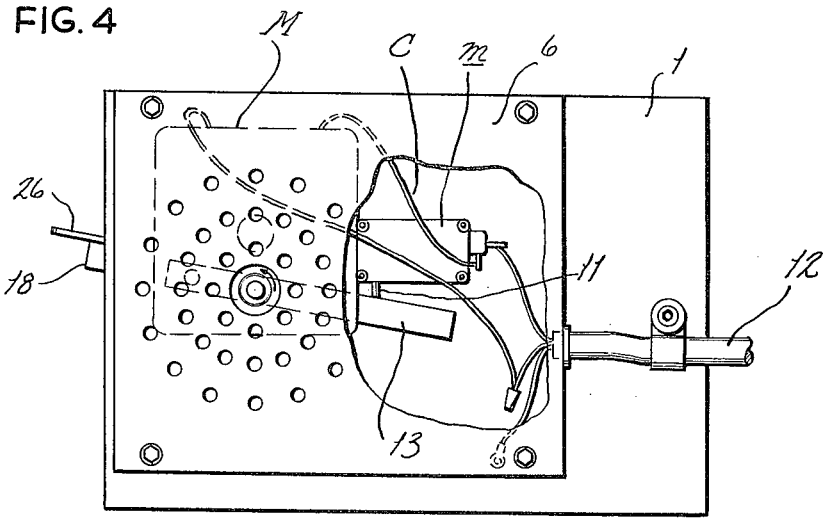
FIG. 4 is an end elevational view taken on the right hand side of FIG. 2 and with a portion of the motor housing broken away.

It will thus be seen that control arm 13 is eccentrically mounted upon shaft 14 so that its major portion is rearwardly thereof and, hence, through gravity will normally extend downwardly, in which condition it will exercise no force upon actuating arm 11 so that said switch *m* will be in open condition. Upon rocking of shaft 14 in a counterclockwise direction, as viewed by the arrow in FIG. 4, as will be shown more fully hereinbelow, said control arm will be caused to rock upwardly in its rearward end portion thereby effecting an upward depressing movement upon actuating arm 11 so as to close switch *m* and, accordingly, energize motor M with resultant rotation of shaft 8. With reference to the drawings, it will be seen that control shaft 14 is located forwardly and slightly downwardly of the circumferential face of sleeve 10 for purposes presently appearing.

Control shaft 14 between side plates 1,1′ is provided on its normally forward portion with a plurality of longitudinally extending, spaced-apart flat zones 17, each of which is in correspondence to a control key 18 having a relatively elongated stem 19 which may be quadrilateral in cross section having parallel top and bottom walls 20, 21, respectively, with there being a three-sided recess 22 opening downwardly through said bottom wall 21 and of like width as said stem 19. For reasons to be described, recess 22 is eccentric with respect to the length of stem 19 being presented rearwardly of the transverse central line of said stem 18. The recess 22 is provided with a forward wall 23, opposed parallel rearward wall 24, and top wall 25, with the transverse extent of said recess 22 being slightly less than the length of the associated control shaft flat 17 so that when said keys 18 are disposed upon control shaft 14, the forward wall 23 of recess 22 will be in confronting relationship to the related flat 17 (see FIGS. 3 and 5). The longitudinal extent of recess 22, that is, the distance between front and rear wall 23, 24 thereof, is but limitedly greater than the cross section of shaft 14 through flats 17. With said keys 18 disposed upon shaft 14, with the flat bearing portions received within recesses 22, the rearward end portions of stem 19 will extend beneath sleeve 10 of shaft 8 (see FIGS. 3 and 5) and by reason of the eccentricity of recess 22 said rearward end would normally be urged toward sleeve 10, but with no pressure upon the related key the contact between the rearward portion of said key 18 and sleeve 10 is of a non-forceful, merely lightly contiguous character. Each key 18 thus in its forward portion extends forwardly of plates 1,1′ and at its front extremity mounts a flat disc 26 for facilitating key operation, as will be shown.

From the foregoing it is, of course, apparent that the length of shaft 14 is a matter of choice as is the number of flats 17 so that a predetermined number of keys 18 may be seated thereupon. As will be developed more fully hereinbelow, the number of keys 18 is in direct correspondence to the number of discrete adhesive label sources to be accommodated by machine A.

It is also to be observed that the eccentric mounting of control arm 13 upon control shaft 14 also urges the latter in such condition that keys 18 will be in normally non-forceful engagement with sleeve 10 when switch *m* is open.

Figure 3:
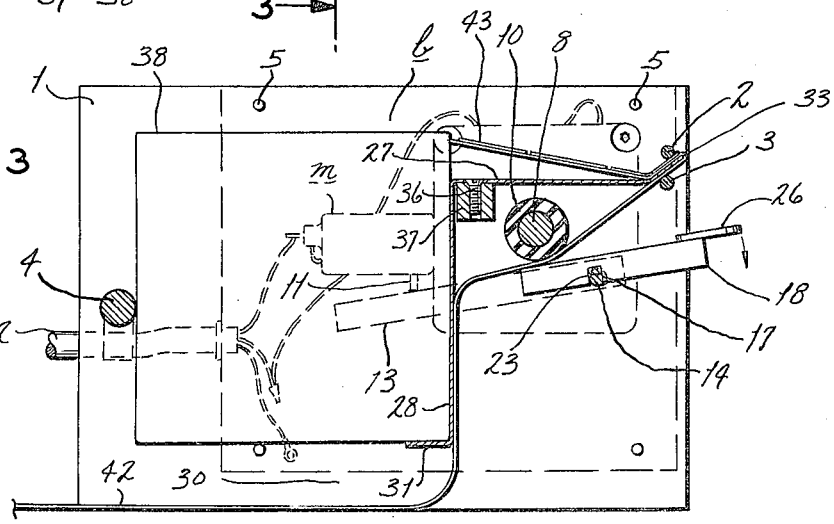
FIG. 3 is a vertical transverse sectional view taken on the line 3—3 of FIG. 2, but illustrating the control switch in open condition.

With machine A suitably connected to a voltage source, the application of a depressing force upon disc 26 of any key 18 will cause a downward rocking of the same at its forward end as in the direction of the arrow shown in FIG. 3 with a coupling engagement brought about between such key 18 and shaft 14 by reason of the abutment between flat 17 and recess wall 23 so as to cause a slight torque upon shaft 14 resulting in control arm 13 being swung upwardly at its rearward end to lift actuating arm 11 and thereby close switch *m* with consequent energization of prime mover M and resultant rotation of shaft 8. Concurrently, the rearward upper end of the operated key will be swung upwardly but slightly into snug engagement with sleeve 10 for purposes to be shown.

Thus, from the foregoing, the novel configuration of each key 18 and its coaction with the related flat 17 on control shaft 14 will become apparent and demonstrates the ease with which machine A may be operated since merely a light pressure is required for application upon the respective disc 26 to effect the multiple purpose of causing rotation of shaft 8 and to bring the particular key into frictional engagement with sleeve 10. Upon withdrawal of pressure from the selected key disc 26, as by mere lifting of one's finger, control shaft 14 will rock returningly causing control arm 13 to drop away from actuating arm 11 and thereby open switch *m* with the de-energization of prime mover M and simultaneous loss of engagement between such key 18 and sleeve 10 with restoration to the condition as shown in FIG. 3.

Located spacedly above friction sleeve 10 is a flat plate 27 extending transversely between side plates 1,1′ and terminating at its rearward end rearwardly of sleeve 10 in continuity with the upper end of a vertical wall-forming section 28 which extends downwardly between said plates 1,1′ and with its bottom edge terminating spacedly above the lower ends of said plates, as at 29, for developing a passage 30, the lower limit of which would be constituted of the particular support surface for machine A, such as a table top. At its said lower end 29 said section 28 is provided with a short rearwardly bent support flange 31.

Plate 27 is also located downwardly of the upper end of side plates 1,1′ and in its forward end portion immediately rearwardly of the leading edges of said side plates 1,1′ is upwardly and forwardly inclined, as at 32, to present a discharge edge 33 for purposes presently appearing. Above and below the inclined section 32 of plate 27 are guide rods 2, 3 respectively, which are rigid at their ends within side plates 1, 1′; the said rods being axially parallel and with their respective spacing between the adjacent portions of said plate inclined section 32 being predetermined for purposes presently appearing.

Plate 27, together with wall 28, is rendered stable in position by means of screws 36 being threadedly received within tapped bosses 37 fixed on side plates 1,1′.

Wall section 28, together with support flange 31 and bar 4 coact to define a retention zone, indicated broadly *z*, for maintaining a bank of discrete label rolls each being preferably contained within a suitable casing, as at 38. Each box-like casing 38, which may be made of any suitable material, such as cardboard, and being generally quadrilateral in character, is disposed within zone *z* so that its forward face, as at 39, abuts against the rearward face of wall section 28 and its forward under surface 40 being disposed upon flange 31; and with its rearward face 41 being restrained by bar 4 (see FIG. 3). Thus, said box-like casing 38 may be easily inserted into machine A, and equally easily withdrawn therefrom through the normally upper open end, as at *b*, between said plates 1,1′.

Figure 2:
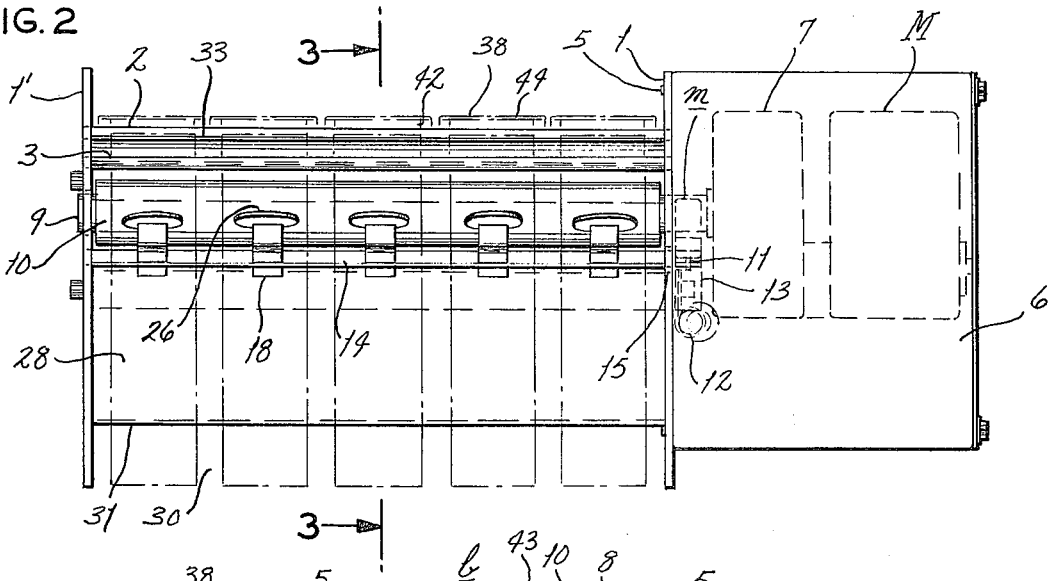
FIG. 2 is a front elevational view.

With particular reference to FIGS. 1 and 2, it will be seen that the spacing of flats 17 upon control shaft 14, with consequent complementary spacing of keys 18, is dependent upon the thickness of box-like casing 38 as there is one key associated with each such casing 38. As pointed out above, it is indeed evident that machine A may be constructed so as to accommodate any predetermined number of casings 38 with the associated keys 18, but for purposes of illustration only, five of the same have been shown herewith.

Each box-like casing 38 contains a conventional label roll which is formed of a suitable backing strip, as at 42, upon the normally upper surface of which are detachably disposed discrete labels 43 having their backing-confronting surface coated with a pressure sensitive adhesive, but which is readily detached from backing 42.

Figure 5:
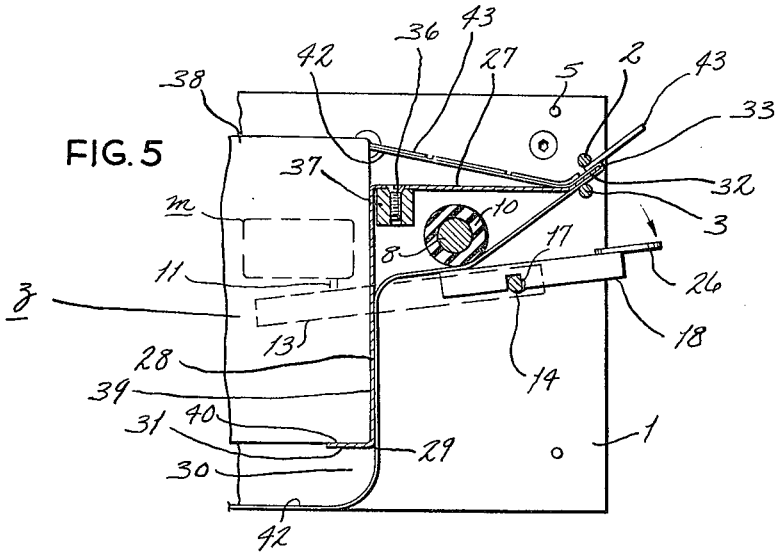
FIG. 5 is a fragmentary vertical transverse sectional view taken substantially on the line 3—3 of FIG. 2, but illustrating the operating switch in closed condition.
Figure 6:
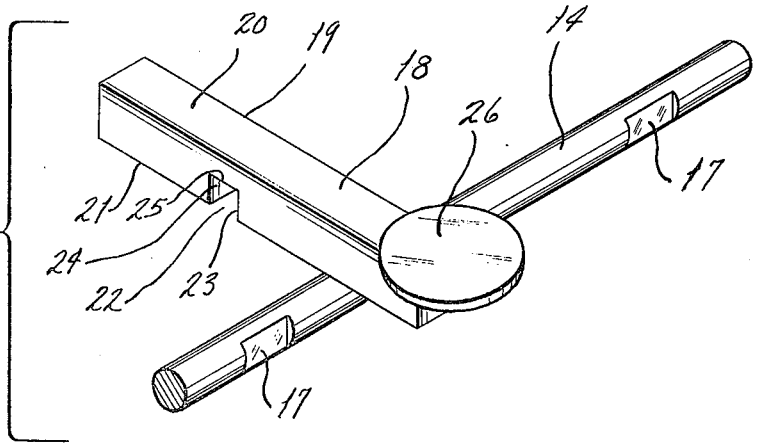
FIG. 6 is an enlarged perspective exploded view of an operating key and the switch or control rod.

Each box-like casing 38 is provided at the upper end of its forward face 39 with a transversely extending slit-like discharge opening 44 through which the leading end of the enclosed roll may be discharged. With reference to FIG. 5 it will be seen that casings 38 are of such height so as to extend above plate 27 whereby the particular backing strip 42 will progress downwardly from opening 44 and on to said plate 27 at the lower or rearward portion of inclined section 32. The backing strip 42 is then lead upwardly along the upper surface of inclined section 32 between same and rod 2, and then reflexively directed about discharge edge 33 for return along the under surface of inclined section 32 between same and rod 3. Therefrom, backing strip 42 is lead between the under portion of friction sleeve 10 and the underlying portion of the top wall 20 of the associated key 18 and, continuingly, the said backing strip 42 then proceeds toward wall section 28 downwardly along the forward face thereof, and into passage 30 for ultimate travel rearwardly therefrom.

The backing strip 42 of the roll of each box-like casing 38 follows a similar line of travel when the particular key 18 is depressed.

From the foregoing it will thus be seen that upon depression of the associated key 18, the backing strip 42 is sufficiently snugly gripped between sleeve 10 and the key 18 so that as shaft 8 rotates, a pulling effect is developed which causes the tape to travel from its roll within its related casing 38 and being pulled reflexively about edge 33. Since the labels 43 are not in contact with the inclined section 32, the same will become detached from the backing strip 42 (see FIG. 5) so that the operator may easily grab same as it becomes freed, or the label will descend through gravity into a collector (not shown).

Each box-like casing 38 will contain a roll with a preselected label thereon so that depending upon the particular label desired, the operator will depress the associated key 18 and the label 43 from the selected roll will thereby be dispensed with all other rolls being thus in a quiescent condition since the keys 18 associated therewith will remain in non-engaged, friction-producing relationship to the now rotating sleeve 10.

In actuality, the extent of travel of the individual backing strip 42 is indeed limited to provide a single label so that only a momentary depression of the particular key is required.

Thus, the present invention presents a structure of marked simplicity for permitting of selected dispensing of one or more types of labels from a relatively large selection and which is resistant to breakdown by means of the novel configuration of the control shaft 14 and the associated keys 18, as well as the cooperation therebetween.

It should be clear from the foregoing that in describing the basic operation of the device, reference has been made to a contact between the individual keys and sleeve 10, whereas in actuality, the backing strips are actually pulled therebetween so that the keys 18 do not necessarily come into direct contact with the sleeve 10 and the suggestion to the contrary was merely to describe the basic cooperation.

Having described our invention, what we claim and desire to obtain by Letters Patent is:

1. A multiple label dispenser comprising a frame having a zone for receiving a plurality of independent rolls of backing strips having discrete label-forming members removably adhesively secured to the normally upper face thereof, an inclined discharge edge forming member provided on said frame forwardly of said rolls, guide elements for directing said roll backing strips reflexively about said edge, a drive shaft mounted for rotation upon said frame downwardly and rearwardly of said discharge edge, a prime mover operatively engaged to said drive shaft, a normally open control switch operatively connected to said prime mover, a control rod rockably mounted on said frame in spaced apart axially parallel relationship to said drive shaft, a key-forming element rockably disposed upon said control rod in correspondence to each backing roll and having a rearward portion beneath said drive shaft and a forward portion forwardly of said control rod, means engaging said key between its ends upon said control rod so that upon rocking of said key the rearward portion thereof will be brought into force-producing contact with said drive shaft for effecting a pulling upon a backing strip led therebetween from the discharge edge, and means mounted on one end of said control rod for engaging said control switch upon rocking of said control rod to close said control switch for actuating said prime mover while the particular key is in rocked condition.

2. A multiple label dispenser as defined in claim 1 and further characterized by said normally open control switch having a depending actuating arm, said means effecting closing of said normally operating switch being a control arm eccentrically mounted on said one end of said control rod so that its rearward portion is normally biased downwardly and beneath said actuating arm whereby upon rocking of said control rod said rearward end of said control arm will be swung upwardly to effect switch-closing action with said actuating arm.

3. A multiple label dispenser as defined in claim 1 and further characterized by each key being loosely, unattachedly seated upon the control rod and there being cooperative means between each key and said control rod for interengagement upon depression of said key to effect a coupling for causing rocking of the control rod.

4. A multiple label dispenser as defined in claim 3 and further characterized by said cooperative means comprising confronting flat surfaces provided upon said key and said control rod for surfacewise engagement upon key depression to effect coupling action.

5. A multiple label dispenser as defined in claim 3 and further characterized by said cooperative means comprising a peripheral flattened zone provided on said rod in correspondence to each key, each key having an upwardly opening recess in its under portion with a forward flat face for normal confronting relationship to the respective flat zone on the control rod so that upon depression of the forward end of said key the said flattened zone and forward face of said recess are brought into snug surface-to-surface engagement to cause a coupling between said rod and said key whereby the rod is rotated to effect energization of the prime mover as well as to cause the rearward portion of the key to be brought into snug engagement with the overlying portion of the drive shaft for frictional engagement of the backing strip therebetween so as to cause a pulling force thereon.

6. A multiple label dispenser as defined in claim 5 and further characterized by there being a depression disc formed at the forward end of each key.

7. A multiple label dispenser as defined in claim 5 and further characterized by the extent of said key recess in a direction lengthwise of the key being slightly greater than the thickness of the control rod through the flattened zone so that when the key is in a state of rest, coupling action between the key and rod is denied.

8. A multiple label dispenser comprising a frame having a zone for receiving a plurality of independent rolls of backing strips having discrete label-forming members removably adhesively secured to the normally upper face thereof, an inclined discharge edge forming member provided on said frame forwardly of said rolls, guide elements for directing said roll backing strips reflexively about said edge, a drive shaft mounted for rotation upon said frame downwardly and rearwardly of said discharge edge, a prime mover operatively engaged to said drive shaft, a normally open control switch operatively connected to said prime mover, a control rod rockably mounted on said frame in spaced apart axially parallel relationship to said drive shaft, a key-forming element rockably disposed upon said control rod in correspondence to each backing roll and having a rearward portion beneath said drive shaft and a forward portion forwardly of said control rod, each key being loosely, unattachedly seated upon the control rod and there being cooperative means between each key and said control rod for interengagement upon depression of said key to effect a coupling for causing rocking of the control rod whereby the rearward portion of the depressed key will be brought into force-producing contact with said drive shaft for effecting a pulling upon a backing strip led therebetween from the discharge edge, and means interconnecting said control rod and said normally open control switch for closing of the latter upon depression of a key to energize said prime mover.

9. A multiple label dispenser as defined in claim 8 and further characterized by said cooperative means comprising confronting flat surfaces provided upon said key and said control rod for surfacewise engagement upon key depression to effect coupling action.

10. A multiple label dispenser as defined in claim 8 and further characterized by said cooperative means comprising a peripheral flattened zone provided on said rod in correspondence to each key, each key having an upwardly opening recess in its under portion with a forward flat face for normal confronting relationship to the respective flat zone on the control rod so that upon depression of the forward end of said key the said flattened zone and forward face of said recess are brought into snug surface-to-surface engagement to cause a coupling between said rod and said key whereby the rod is rotated to effect energization of the prime mover as well as to cause the rearward portion of the key to be brought into snug engagement with the overlying portion of the drive shaft for frictional engagement of the backing strip therebetween so as to cause a pulling force thereon.

11. A multiple label dispenser as defined in claim 10 and further characterized by there being a depression disc formed at the forward end of each key.

12. A multiple label dispenser as defined in claim 10 and further characterized by the extent of said key recess in a direction lengthwise of the key being slightly greater than the thickness of the control rod through the flattened zone so that when the key is in a state of rest, coupling action between the key and rod is denied.

* * * * *